US010122116B2

(12) United States Patent
Troufflard et al.

(10) Patent No.: US 10,122,116 B2
(45) Date of Patent: Nov. 6, 2018

(54) ELECTRICAL POWER-POINT ASSEMBLY WITH ELECTRICAL DISCONNECTION SOLUTION

(71) Applicant: GULPLUG, Grenoble (FR)

(72) Inventors: Ronan Troufflard, Saint Egrève (FR); Amandine Bray, Grenoble (FR)

(73) Assignee: GULPLUG, Grenoble (FR)

( * ) Notice: Subject to any disclaimer, the term of this patent is extended or adjusted under 35 U.S.C. 154(b) by 0 days.

(21) Appl. No.: 15/741,613

(22) PCT Filed: Jul. 4, 2016

(86) PCT No.: PCT/FR2016/051691
§ 371 (c)(1),
(2) Date: Jan. 3, 2018

(87) PCT Pub. No.: WO2017/009539
PCT Pub. Date: Jan. 19, 2017

(65) Prior Publication Data

US 2018/0198232 A1 Jul. 12, 2018

(30) Foreign Application Priority Data

Jul. 10, 2015 (FR) ..... 15 56579

(51) Int. Cl.
*H01R 13/53* (2006.01)
*H01R 13/62* (2006.01)
(Continued)

(52) U.S. Cl.
CPC ..... *H01R 13/6205* (2013.01); *H01R 13/7037* (2013.01); *H01R 13/53* (2013.01); *H01R 13/6485* (2013.01); *H01R 24/38* (2013.01)

(58) Field of Classification Search
None
See application file for complete search history.

(56) References Cited

U.S. PATENT DOCUMENTS 3,496,500 A 2/1970 Romary
4,156,265 A 5/1979 Rose
(Continued)

FOREIGN PATENT DOCUMENTS

EP 2667459 11/2013
FR 2609578 7/1988
(Continued)

*Primary Examiner* — Tho D Ta
(74) *Attorney, Agent, or Firm* — Occhiuti & Rohlicek LLP

(57) ABSTRACT

The invention relates to an electrical power-point assembly including: a socket comprising at least two first electrical contacts and a first magnetic portion arranged to be moved by a magnetic effect, in order to move the two first electrical contacts toward the exterior of the socket; a plug comprising two second electrical contacts that are intended to be electrically connected to the two first electrical contacts and a second magnetic portion for moving, via a magnetic effect, the first magnetic portion, in order to drive the first electrical contacts toward the exterior of the socket; detecting means comprising a sensor for measuring the magnetic flux flowing between the two magnetic portions and a processing unit that is arranged to generate a control signal (SIG); and disconnecting means arranged to disconnect the power supply circuit on reception of the control signal (SIG).

10 Claims, 3 Drawing Sheets

(51) Int. Cl.

| | |
|---|---|
| ***H01R 13/703*** | (2006.01) |
| *H01R 24/38* | (2011.01) |
| *H01R 13/648* | (2006.01) |

(56) References Cited

U.S. PATENT DOCUMENTS

| | | | | |
|---|---|---|---|---|
| 7,311,526 | B2 * | 12/2007 | Rohrbach ..... | H01R 13/6205 439/218 |
| 2007/0072443 | A1 | 3/2007 | Rohrback et al. | |
| 2016/0020557 | A1 * | 1/2016 | Daoura ..... | H01R 13/6205 439/38 |

FOREIGN PATENT DOCUMENTS

| | | |
|---|---|---|
| FR | 2835104 | 7/2003 |
| FR | 3012263 | 4/2015 |
| JP | 2007073373 | 3/2007 |

* cited by examiner

ELECTRICAL POWER-POINT ASSEMBLY WITH ELECTRICAL DISCONNECTION SOLUTION

CROSS REFERENCE TO RELATED APPLICATION

This application is the national phase under 35 USC 371 of international application no. PCT/FR2016/051691, filed Jul. 4, 2016, which claims the benefit of the Jul. 10, 2015 priority date of French application no. 1556579.

TECHNICAL FIELD OF THE INVENTION

The present invention relates to an electrical connector assembly. The electrical connector assembly includes a socket and an electrical plug that is intended to be fitted to the socket. The association of the plug and of the socket is achieved by magnetic effect.

PRIOR ART

Patent application WO2012032230A1 describes an electrical connector assembly comprising a socket and an electrical plug that is intended to be fitted to the socket. The plug comprises two electrical tracks that are intended to be electrically connected to two electrical contacts of the socket. The two electrical contacts exhibit the particularity of moving between a retracted position inside the socket and a position outside the socket so as to prevent any access to the contacts when the appliance to be connected is not in use. When the plug is brought close to the socket, magnetic control means, comprising a permanent magnet that is incorporated within the plug and a movable magnetic element that is housed in the socket and rigidly connected to the electrical contacts, allow the electrical contacts to be extracted from the socket and their connection with the electrical tracks. When the plug is uncoupled from the socket, a mechanical spring system repositions the movable mechanism inside the socket. During this separation phase, the current that was flowing between the plug and the socket forms an electric arc that can last up to 10 ms. Now, these electric arcs tend to wear and materially and visually damage the areas of electrical connection between the plug and the socket.

U.S. Pat. No. 4,156,265 provides a solution in which the electrical circuit is disconnected when a bulb is unscrewed from its socket. The solution consists in employing a reed microswitch that is controlled by the mechanical movement of the bulb with respect to the socket. However, this solution is not suitable for an electrical connector assembly such as that described above where the withdrawal of the plug does not always follow one and the same motion, which may be axial or be achieved by pivoting with respect to the socket.

Document JP2007-73373 describes a connection solution employing an electromagnet that is energized when the plug and the socket are brought together. In the event of a power failure, the electromagnet is no longer energized and the plug is automatically disconnected from the socket given that the electromagnet is no longer energized. When the current is re-established, the appliance is then no longer supplied with power, avoiding the risk of a short circuit.

The object of the invention is to provide a solution that is suited to an electrical connector assembly comprising a socket and a plug in order to limit, or even to avoid entirely, any damage to the electrical connection areas when the plug is separated from the socket and to achieve this regardless of the angle of withdrawal of the plug with respect to the socket. The solution of the invention is particularly suitable for a magnetically coupled electrical connector assembly in which the electrical contacts are extracted from the socket by magnetic effect.

DISCLOSURE OF THE INVENTION

This object is achieved by an electrical connector assembly including:

- a socket comprising at least two first electrical contacts that are linked to an electrical power supply circuit, a first magnetic portion that is constrained to move with the two first electrical contacts, said first magnetic portion being arranged to move by magnetic effect between a first position in which the first electrical contacts are retracted inside the socket and a second position in which the first electrical contacts are outside the socket;
- a plug that is intended to be coupled to the socket and comprises two second electrical contacts that are intended to be electrically connected to the two first electrical contacts when the latter are outside the socket and a second magnetic portion that is arranged to face the first magnetic portion when the plug is coupled to the socket in order to move, by magnetic effect, the first magnetic portion toward its second position, driving the first electrical contacts toward the outside of the socket;
- detection means comprising a magnetic flux measurement sensor that is arranged to measure the magnetic flux flowing between the two magnetic portions, a processing unit that is arranged to receive magnetic flux data arising from the magnetic flux sensor and to generate a control signal when the plug is separated from the socket;
- disconnection means cooperating with the detection means and arranged to disconnect the power supply circuit when the control signal arising from the processing unit is received.

According to one particularity, the processing unit includes first means for monitoring the level of variation in magnetic flux with respect to a first threshold value.

According to another particularity, the processing unit includes second means for monitoring the level of flux with respect to a second threshold value. According to another particularity, the processing unit includes a processing logic circuit that is arranged to apply a logic OR operation between a detection signal that is generated by the first monitoring means and a detection signal that is generated by the second monitoring means.

According to another particularity, the disconnection means include an electromechanical relay that is connected to the power supply circuit.

According to another particularity, the socket includes a housing and the assembly includes an electronic circuit board that is housed in said housing, said electronic circuit board including the processing unit and the measurement sensor.

According to another particularity, the first magnetic portion and/or the second magnetic portion includes at least one permanent magnet.

According to another particularity, the measurement sensor is positioned in the circuit along the lines of a magnetic field that is generated by said permanent magnet.

According to another particularity, the assembly includes a ferromagnetic part that is arranged with respect to the permanent magnet so as to channel its magnetic flux with a view to orienting it toward the measurement sensor. Said ferromagnetic part is for example positioned in direct contact with the permanent magnet. The permanent magnet and the ferromagnetic part are for example housed in the housing of the socket and the measurement sensor is attached to this housing.

BRIEF DESCRIPTION OF THE FIGURES

Other features and advantages will become apparent in the following detailed description that is provided with reference to the appended drawings, in which.

DETAILED DESCRIPTION OF AT LEAST ONE EMBODIMENT

Figure 1A:
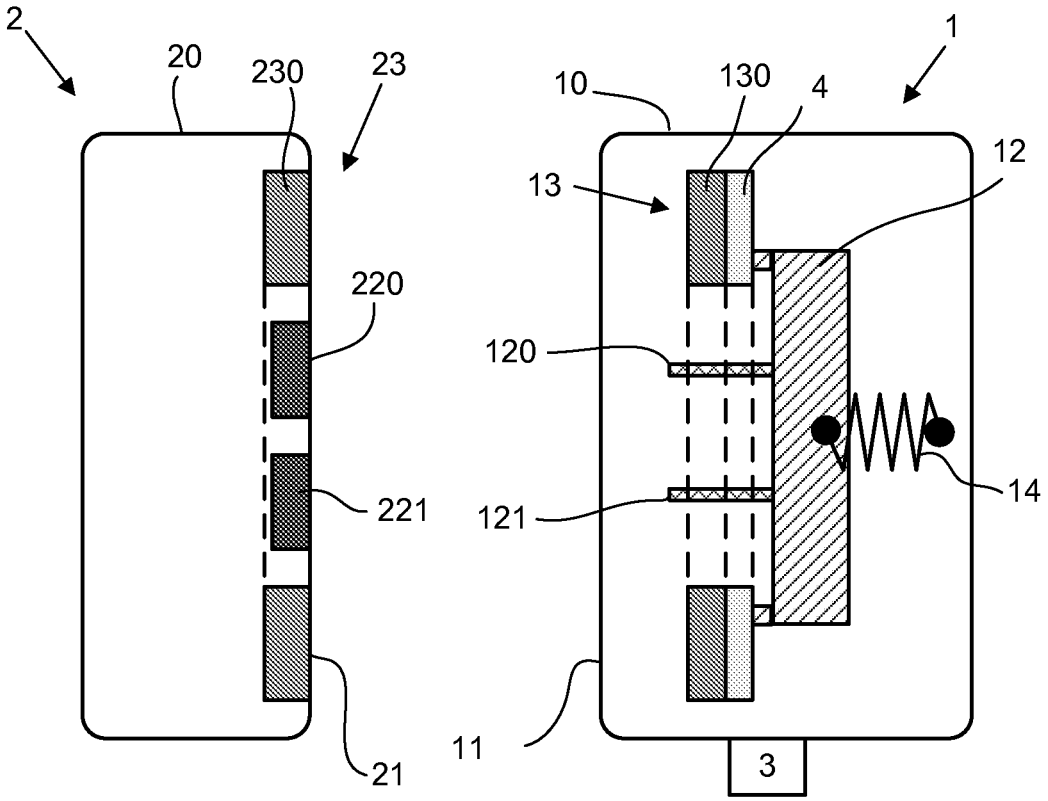
FIGS. 1A and 1B show one example of an architecture of the electrical connector assembly of the invention, with the plug separated from the socket and the plug fitted to the socket respectively.
Figure 1B:
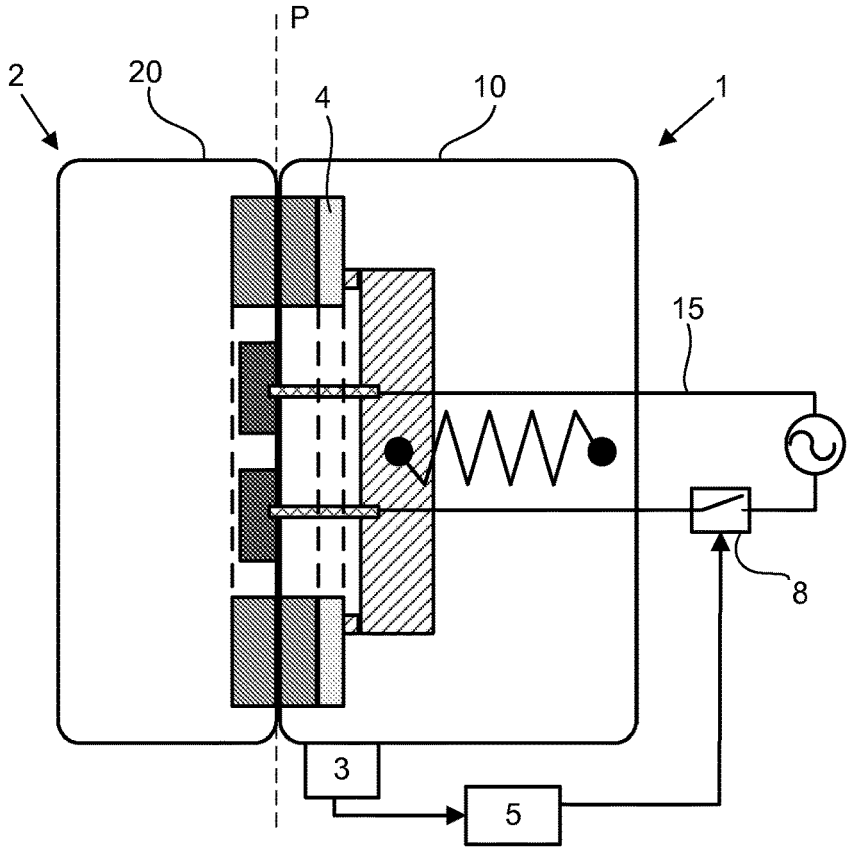

With reference to the appended figures, the electrical connector assembly of the invention includes a socket 1 and an electrical plug 2 that is intended to be fitted to the socket 1.

The socket 1 includes a plastic housing 10 that is intended for example to be embedded in a wall. The socket 1 has a front face 11 to which the electrical plug may be fitted. The socket also includes a movable support 12 to which two first electrical contacts 120, 121 are attached. The two first electrical contacts 120, 121 are linked to an electrical power supply circuit 15 via electrically conductive wires. The socket 1 also includes a first magnetic portion 13 that is constrained to move with the movable support 12 and arranged to move by magnetic effect between a first position and a second position. A spring 14 that is positioned inside the housing 10 of the socket, for example attached both to the housing 10 of the socket and to the movable support 12, is arranged to return the first magnetic portion 13 to its first position when the magnetic effect required for extraction is no longer strong enough. In the first position of the first magnetic portion 13, the first electrical contacts 120, 121 are retracted inside the socket 1 and in the second position of the first magnetic portion 13, the first electrical contacts 120, 121 are outside the socket 1, passing through its front face 11. In its second position, the movable assembly that is formed by the support 12 and the magnetic portion 13 comes into abutment, for example against a portion of the housing 10.

The electrical plug 2 itself includes a plastic housing 20, having a front face 21 that is intended to bear against the front face 11 of the socket 1, defining a joining plane P (defined vertically in the appended figures) between the socket 1 and the plug 2. The plug 2 additionally includes two second electrical contacts 220, 221, for example two electrical tracks that are flush with its front face 21, which contacts are intended to make electrical contact with the two first electrical contacts 120, 121 of the socket 1. The plug also includes a second magnetic portion 23 that is attached inside the housing and is intended to attract the first magnetic portion 13 when the plug 2 is brought close to the socket 1 in order to extract the first electrical contacts 120, 121. Preferably, the two electrical tracks are circular in shape and are positioned concentrically.

The first magnetic portion and/or the second magnetic portion includes at least one permanent magnet so as to generate a magnetic flux between the two magnetic portions.

Various magnetic architectures could thus be envisaged, such as those described in the applications EP2628213, EP2667459, etc. However, these do not form part of the subject matter of the present application and it should be understood that the invention could be adapted to any architecture as long as provision is made for the presence of a maximum magnetic flux between the first magnetic portion and the second magnetic portion when the plug is fitted to the socket, said flux decreasing when the plug is distanced from the socket. With reference to the appended figures, the first magnetic portion 13 includes for example a ring-shaped permanent magnet 130 and the second magnetic portion 23 includes a ring-shaped permanent magnet 230. The permanent magnet 130 and the ferromagnetic part 230 are intended to be positioned coaxially when the plug 2 is brought close to the socket 1. When the plug 2 is facing the socket 1, the permanent magnet 130 and the permanent magnet 203 are arranged so that each has an air gap surface that is parallel to the joining plane.

In such an electrical connector assembly, the invention aims to avoid the appearance of any electric arc in the electrical connection areas when the plug is separated from the socket. It is necessary to detect this separation quickly.

To achieve this, the electrical connector assembly includes:

means for detecting the separation of the plug with respect to the socket;

means 8 for disconnecting the electrical power supply circuit when the plug is separated from the socket.

These means are for example produced on an electronic circuit board that is housed in the housing 10 of the socket 1.

More specifically, the detection means include a sensor 3 for measuring the magnetic flux that is present between the plug and the socket, the magnetic flux being at maximum when the plug 2 is fitted to the socket 1 and decreasing as the distance between the plug 2 and the socket 1 becomes greater. The magnetic flux sensor 3 is judiciously positioned so that it best detects the magnetic flux Φ and its variation.

Preferably, the measurement sensor 3 is positioned on the circuit traversed by the magnetic field lines L that are present between the two magnetic portions 13, 23.

Preferably, the measurement sensor 3 is attached to the socket 1. The measurement sensor 3 is for example attached on the outside of the housing 10 of the socket.

Figure 2:
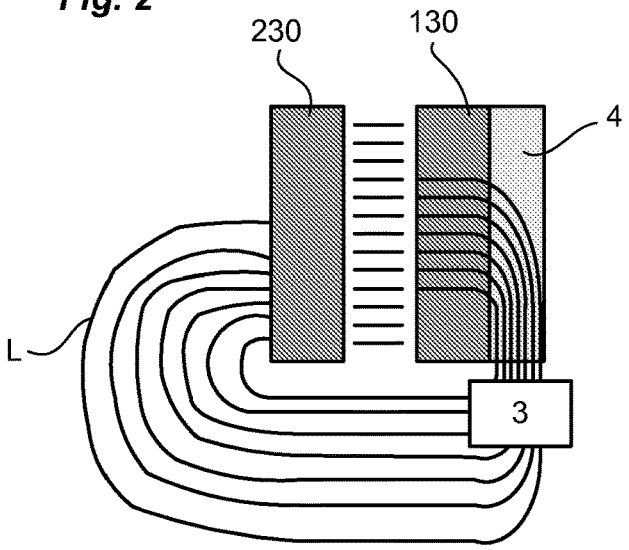
FIG. 2 illustrates the principle of measuring the magnetic flux generated by the employed magnetic assembly.

Advantageously, the detection means may include a part 4 made of ferromagnetic material that is arranged to channel the magnetic flux arising from the permanent magnet that is positioned in the socket in the direction of the measurement sensor 3. FIG. 2 schematically shows the principle of channeling the magnetic flux Φ using a ferromagnetic part 4 and the positioning of the sensor 3 to detect this magnetic flux. The use of this ferromagnetic part 4 make it possible to channel the flux output by the magnet and hence to provide the sensor 3 with a flux that is more constant and that has an intensity that is high enough to be detected. This part 4 exhibits a high relative permeability, thereby providing it with good flux-channeling capabilities. Moreover, the large difference in permeability between this ferromagnetic part and air results in the obtainment of flux lines that are highly perpendicular to the flux output face on the ferromagnetic part 4.

Advantageously, the ferromagnetic part 4 is housed in the socket 1. Said part takes the shape of a ring for example. Said part is for example attached to the face of the permanent magnet 130 that is opposite its air gap surface.

Figure 3A:
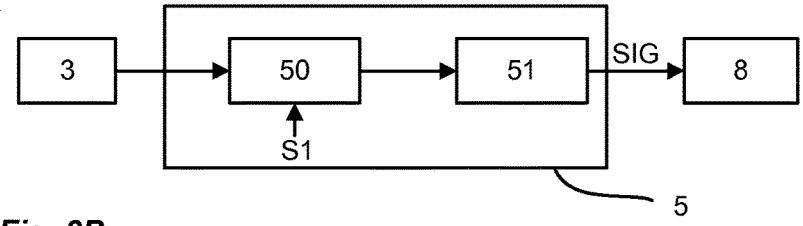
FIGS. 3A and 3B schematically show two variant embodiments of the processing circuit that is employed in the assembly of the invention.

In a first variant embodiment that is shown in FIG. 3A, the detection means include a processing unit 5 including at least one input that is intended to receive analog measurement data arising from the magnetic flux measurement sensor 3 and at least one output for which the processing unit 5 is capable of generating a disconnection control signal SIG. The processing unit 5 includes in particular means for monitoring the variation in the measured magnetic flux. When the variation in flux falls below a threshold value S1, the processing unit 5 is arranged to generate the disconnection control signal SIG for the disconnection means 8. The monitoring means include means 50 for determining the variation in flux by calculating the derivative of the curve of the magnetic flux and a comparator 51 receiving, as input, the calculated derivative and a threshold value S1 in order to determine said disconnection control signal SIG. The monitoring means are for example produced in the form of an electronic circuit with discrete components. As a variant embodiment, the monitoring means could include a microcontroller processing the measurement data digitally.

Figure 3B:
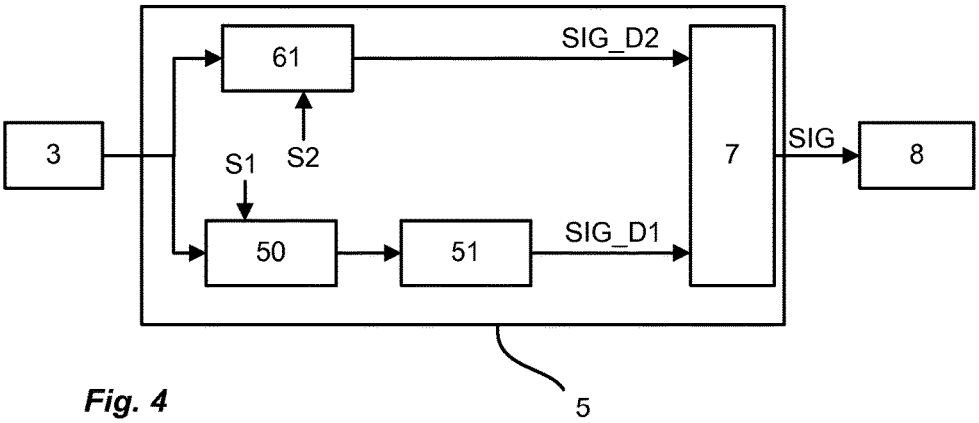

In a second variant embodiment that is shown in FIG. 3B, the detection means also include a processing unit 5 including at least one input that is intended to receive analog measurement data arising from the magnetic flux measurement sensor 3 and at least one output for which the processing unit 5 is capable of generating a disconnection control signal SIG. This processing unit 5 is provided with first means for monitoring the variation in magnetic flux such as those described above in conjunction with the first variant embodiment and second means for monitoring the level of magnetic flux. These second monitoring means include for example a comparator 61 receiving, as input, the flux measurement data arising from the measurement sensor 3 and a threshold value S2 that is required for comparison. When the flux level falls below the threshold value S2, the monitoring means generate a detection signal SIG_D2.

According to this variant embodiment, the processing unit 5 includes a processing logic circuit 7 that is arranged to receive a first detection signal SIG_D1 arising from the first monitoring means and/or a second detection signal SIG_D2 arising from the second monitoring means. The processing logic circuit 7 implements a logic OR operation to generate the disconnection control signal SIG that is intended for the disconnection means when the first detection signal SIG_D1 and/or the second detection signal SIG_D2 are/is received.

More specifically, the disconnection means 8 are controlled on reception of the disconnection control signal SIG arising from the processing unit 5. They include for example an electromechanical relay that is connected in series with the electrical power supply circuit that is connected to the electrical contacts of the socket. Advantageously, they may also include a flyback diode that is connected in parallel with the winding of the electromechanical relay and potentially a resistor that is connected in series with the flyback diode in order to improve the reaction time of the electromechanical relay. The disconnection means, in particular the electromechanical relay, are for example produced on an electronic circuit board that is housed in the housing (10) of the socket. This electronic circuit board may be identical to that accommodating the detection means that are described above. The electrical power supply circuit 15 includes for example two terminals that are connected to the electromechanical relay.

Figure 4:
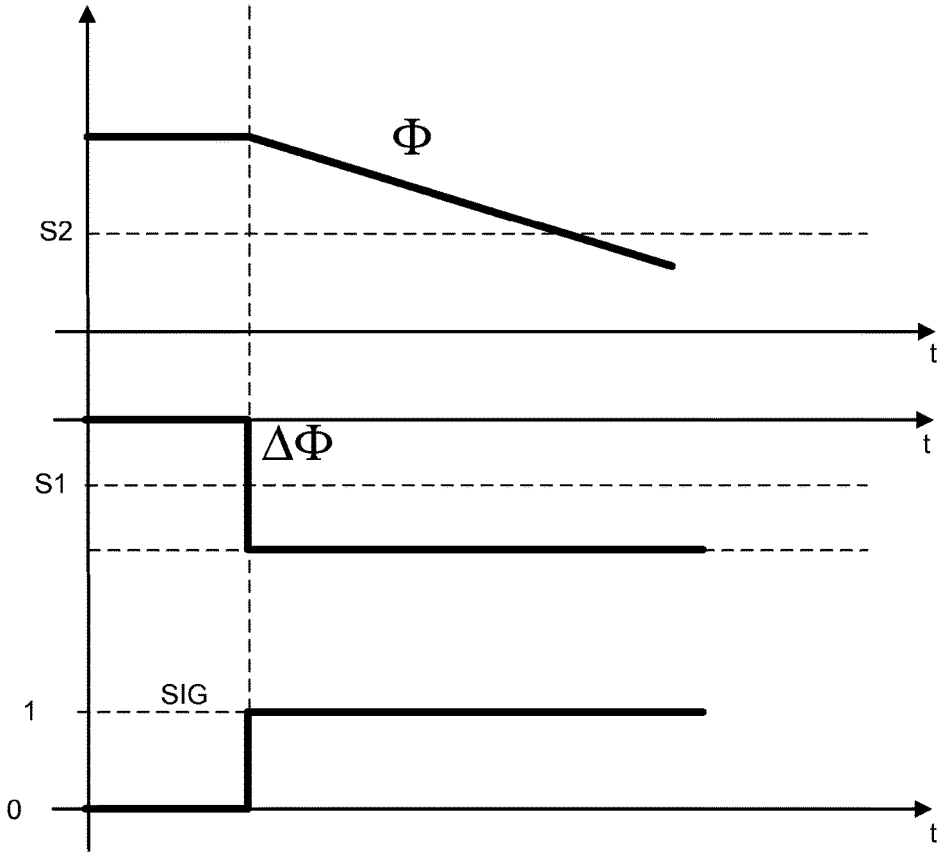
FIG. 4 illustrates the detection principle that is employed in the invention.

The curves shown in FIG. 4 illustrate the detection of separation both by the level of variation in the magnetic flux and by the variation in the magnetic flux level. It is understood that the disconnection control signal SIG transitions to the high state when the flux level falls below the threshold value S2 and/or when the variation in flux falls below the threshold value S1.

The solution of the invention has numerous advantages, among which:

- the simplicity and the reliability of the employed means;
- the compactness of the employed means, a simple electronic circuit board being required that can easily be housed in the housing of the socket;
- the possibility of detecting the separation of the plug from the socket regardless of the angle of withdrawal of the plug.

The invention claimed is:

1. An apparatus comprising an electrical-connector assembly, wherein said electrical-connector assembly comprises a socket, a plug, a detector, and a disconnector, wherein said socket comprises at least two first electrical contacts and a first magnetic portion, wherein said at least two first electrical contacts are linked to an electrical power supply circuit, wherein said first magnetic portion is constrained to move with said two first electrical contacts, wherein said first magnetic portion is arranged to move by magnetic effect between first and second positions, wherein, in said first position, said first electrical contacts are retracted inside said socket, wherein, in said second position, said first electrical contacts are outside said socket, wherein said plug is configured to be coupled to said socket, wherein said plug comprises two second electrical contacts that are configured to be electrically connected to said two first electrical contacts when said two first electrical contacts are outside said socket, wherein a second magnetic portion is arranged to face said first magnetic portion when said plug is coupled to said socket in order to move, by magnetic effect, said first magnetic portion toward said second position thereof, thereby driving said first electrical contacts toward an outside of said socket, wherein said detector comprises a processing unit and a sensor, wherein said sensor is a magnetic-flux measurement-sensor, wherein said sensor is arranged to measure magnetic flux between said first and second magnetic portions, wherein said processing unit is arranged to receive magnetic flux data arising from said magnetic-flux measurement-sensor and to generate a control signal when said plug is separated from said socket, and wherein said disconnector is configured to cooperate with said detector to disconnect said electrical power supply circuit when said control signal is received.

2. The apparatus of claim 1, wherein said processing unit comprises a first monitor, said first monitor being configured to monitor a level of variation in magnetic flux with respect to a first threshold value.

3. The apparatus of claim 1, wherein said processing unit comprises first and second monitors, wherein said first monitor is configured to monitor a level of variation in magnetic flux with respect to a first threshold value and wherein said second monitor is configured to monitor a level of variation in magnetic flux with respect to a second threshold value.

4. The apparatus of claim 1, wherein said processing unit comprises a first monitor, a second monitor, and a logic circuit, wherein said first monitor is configured to monitor a level of variation in magnetic flux with respect to a first threshold value and wherein said second monitor is configured to monitor a level of variation in magnetic flux with respect to a second threshold value, wherein said logic circuit is arranged to apply a logical OR operation between a detection signal that is generated by said first monitor and a detection signal that is generated by said second monitor.

5. The apparatus of claim 1, wherein said disconnector comprises an electromechanical relay that is connected to said power supply circuit.

6. The apparatus of claim 1, wherein at least one of said first magnetic portion and said second magnetic portion includes at least one permanent magnet.

7. The apparatus of claim 1, wherein said sensor is positioned in said circuit along lines of a magnetic field that is generated by a permanent magnet, wherein said permanent magnet is a constituent of at least one of said first and second magnetic portions.

8. The apparatus of claim 7, further comprising a ferromagnetic part that is arranged with respect to said permanent magnet to cause magnetic flux arising from said permanent magnet to be oriented toward said sensor.

9. The apparatus of claim 8, wherein said socket comprises a housing and an electronic circuit board, wherein said electronic circuit board is housed in said housing, and wherein said processing unit and said sensor are disposed on said electronic circuit board.

10. The apparatus of claim 9, wherein said permanent magnet and said ferromagnetic part are housed in said housing.

* * * * *